US009677788B2

(12) United States Patent
Lifson et al.

(10) Patent No.: US 9,677,788 B2
(45) Date of Patent: Jun. 13, 2017

(54) REFRIGERANT SYSTEM WITH MULTIPLE LOAD MODES

(75) Inventors: Alexander Lifson, Manlius, NY (US); Mark J. Perkovich, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 830 days.

(21) Appl. No.: 13/322,954

(22) PCT Filed: May 26, 2010

(86) PCT No.: PCT/US2010/036138

§ 371 (c)(1),
(2), (4) Date: Nov. 29, 2011

(87) PCT Pub. No.: WO2010/144255

PCT Pub. Date: Dec. 16, 2010

(65) Prior Publication Data

US 2012/0073318 A1 Mar. 29, 2012

Related U.S. Application Data

(60) Provisional application No. 61/186,576, filed on Jun. 12, 2009.

(51) Int. Cl.
*F25B 1/10* (2006.01)
*F25B 41/04* (2006.01)

(52) U.S. Cl.
CPC ..... *F25B 1/10* (2013.01); *F25B 41/043* (2013.01); *F25B 2400/0401* (2013.01);
(Continued)

(58) Field of Classification Search
CPC ..... F25B 41/043; F25B 2600/2501; F25B 2600/2509; F25B 1/10; F25B 2400/0401
(Continued)

(56) References Cited

U.S. PATENT DOCUMENTS 3,885,938 A 5/1975 Ordonez
4,257,795 A 3/1981 Shaw
(Continued)

FOREIGN PATENT DOCUMENTS

CN 1795353 A 6/2006
CN 101171464 A 4/2008
(Continued)

OTHER PUBLICATIONS

PCT International Search Report and Written Opinion of the International Searching Authority for International Application No. PCT/US2010/036138, Aug. 16, 2010, 11 pages.
(Continued)

*Primary Examiner* — Emmanuel Duke
(74) *Attorney, Agent, or Firm* — Cantor Colburn LLP

(57) ABSTRACT

A refrigerant system capable of operating at multiple capacity modes includes an evaporator, a multi-stage compressor assembly, a first fluid flow path, a second fluid flow path, a first valve, and a second valve. The multi-stage compressor assembly has a first stage and a second stage. The first fluid flow path extends from the evaporator to the first stage of the multi-stage compressor assembly. The second fluid flow path connects to the first fluid flow path and to the multi-stage compressor assembly between the first stage and the second stage.

18 Claims, 1 Drawing Sheet

(52) U.S. Cl.
CPC ... *F25B 2400/13* (2013.01); *F25B 2600/2501* (2013.01); *F25B 2600/2509* (2013.01)

(58) Field of Classification Search
USPC ..... 62/149, 178, 498, 510
See application file for complete search history.

(56) References Cited

U.S. PATENT DOCUMENTS

| | | | | |
|---|---|---|---|---|
| 4,388,048 | A | 6/1983 | Shaw et al. | |
| 4,393,662 | A | 7/1983 | Dirth | |
| 4,787,211 | A * | 11/1988 | Shaw | F25B 1/10 417/248 |
| 5,062,274 | A | 11/1991 | Shaw | |
| 5,207,072 | A | 5/1993 | Arno et al. | |
| 5,626,027 | A | 5/1997 | Dormer et al. | |
| 5,768,901 | A * | 6/1998 | Dormer et al. | 62/175 |
| 6,058,729 | A * | 5/2000 | Lifson | F25B 41/04 236/1 EA |
| 6,374,631 | B1 * | 4/2002 | Lifson | F25B 1/04 62/117 |
| 6,422,846 | B1 | 7/2002 | Zhong et al. | |
| 6,860,114 | B2 | 3/2005 | Jacobsen | |
| 6,892,553 | B1 | 5/2005 | Lifson et al. | |
| 7,353,660 | B2 | 4/2008 | Lifson et al. | |
| 2006/0037336 | A1 * | 2/2006 | Bush | 62/197 |
| 2006/0107685 | A1 | 5/2006 | Lifson | |
| 2006/0165533 | A1 * | 7/2006 | Jurmann | C21D 1/613 417/65 |
| 2007/0022765 | A1 | 2/2007 | Lifson et al. | |
| 2007/0107449 | A1 | 5/2007 | Crane | |
| 2008/0314057 | A1 * | 12/2008 | Lifson | B60H 1/3216 62/228.4 |
| 2011/0023514 | A1 * | 2/2011 | Mitra | F25B 1/10 62/222 |

FOREIGN PATENT DOCUMENTS

| | | | | |
|---|---|---|---|---|
| EP | 0921364 | A2 | 6/1999 | |
| EP | 1953388 | A1 | 8/2008 | |
| EP | 1983275 | A1 | 10/2008 | |
| EP | WO2008130357 | A1 * | 10/2008 | F25B 1/10 |
| FR | 1327933 | A | 5/1963 | |
| WO | 2006118573 | A1 | 11/2006 | |
| WO | WO 2008130358 | A1 * | 10/2008 | F25B 9/008 |

OTHER PUBLICATIONS

Chinese First Office Action and Search report translation for application 201080026015.5, mailed Sep. 13, 2013, 20 pages.
Chinese First Office Action for application 201080026015.5, issued Mar. 20, 2015, mailed Apr. 15, 2015, 12 pages.
Notification of Transmittal of the European Search Resport; PCT/US2010/036138; Jul. 13, 2015, 6 pages.

* cited by examiner

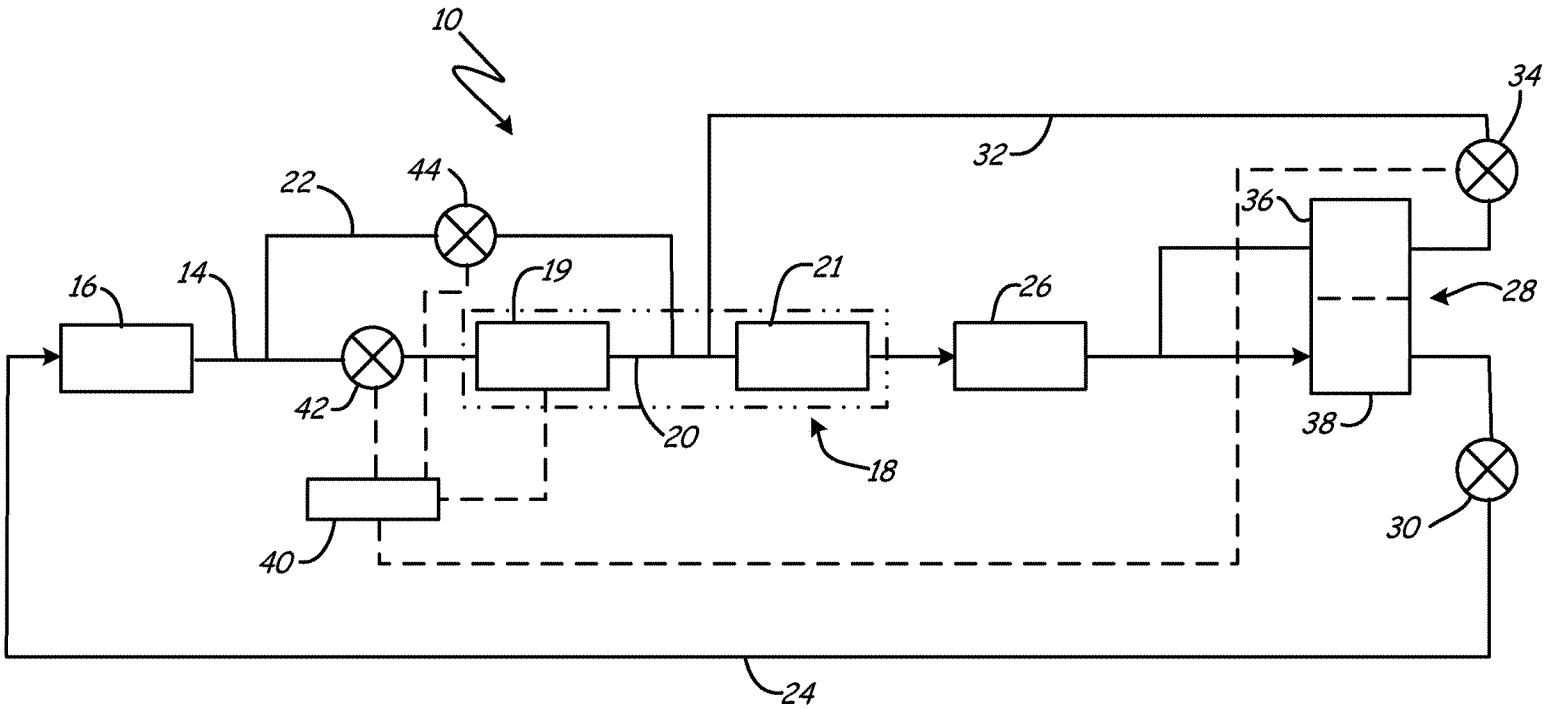
10
16
14
22
44
42
40
19
20
21
18
24
26
32
36
38
34
28
30

REFRIGERANT SYSTEM WITH MULTIPLE LOAD MODES

BACKGROUND

The present invention relates to a refrigeration or air conditioning system, and more particularly, to a refrigerant system configured to operate at multiple capacity modes.

Refrigeration and heating or air conditioning systems (commonly called refrigerant systems) are generally configured with means for system unloading, thereby allowing the systems to improve temperature control accuracy, reliability, and energy efficiency.

Currently the most common means for system unloading is accomplished by unit cycling (i.e., turning the compressor on and off). However, unit cycling does not allow for tight temperature control, and therefore, commonly creates discomfort and/or undesired temperature variations if used to cool an occupied space. Additionally, unit cycling introduces system inefficiencies associated with unit cycling losses and the system must operate with a high refrigerant mass flow rate when the compressor is turned on.

A suction modulation valve is another means commonly utilized for system unloading. With a suction modulation valve unloading is accomplished by limiting the amount of refrigerant flow by partially closing the suction modulation valve. However, a suction modulation valve is relatively expensive and is inefficient for system capacity control due to flow throttling losses when the valve is in a partially closed position.

U.S. Pat. No. 7,353,660 to Lifson et al. discloses a multi-temperature cooling system with unloading. However, this system does not vapor inject refrigerant into an inter-stage of a multi-stage compressor assembly to achieve unloading. Additionally, the flow of refrigerant through the suction line from evaporator 68 to the port 54 of the compressor 52 cannot be throttled by a valve and directed through a bypass line to be injected into the inter-stage of the compressor to achieve unloading.

U.S. Pat. No. 6,860,114 to Jacobsen discloses a system capable of operating at different operational cooling stages. However, the valve 144 Jacobsen discloses in the bypass line is a check valve which only allows refrigerant to flow in one direction. Thus, the opening of valve 144 is controlled solely by pressure differential across it. Because valve 144 requires a specific pressure differential to open, both valve 144 and valve 134 cannot be opened simultaneously to achieve unloading by allowing refrigerant flow to both the first and second stages of compressor 60.

SUMMARY

A refrigerant system capable of operating at multiple capacity modes includes an evaporator, a multi-stage compressor assembly, a first fluid flow path, a second fluid flow path, a first valve, and a second valve. The multi-stage compressor assembly has a first stage and a second stage. The first fluid flow path extends from the evaporator to the first stage of the multi-stage compressor assembly. The second fluid flow path connects to the first fluid flow path and to the multi-stage compressor assembly between the first stage and the second stage. The first valve is disposed along the first fluid flow path at or between the connection between the first fluid flow path and the second fluid flow path and the first stage. The first valve is responsive to control signals to selectively regulate flow of refrigerant to the first stage. The second valve is disposed along the second fluid flow path and is responsive to control signals to selectively regulate flow of refrigerant along the bypass line.

BRIEF DESCRIPTION OF THE DRAWINGS

FIG. 1 is a schematic view of one embodiment of a refrigerant system.

DETAILED DESCRIPTION

FIG. 1 shows one embodiment of a refrigerant system 10 capable of operating in multiple capacity modes or levels. The system 10 includes a suction line 14, an evaporator 16, a multi-stage compressor assembly 18 with a first stage 19, an inter-stage line 20, and a second stage 21, a bypass line 22, a main flow line 24 a heat exchanger 26, an economizer heat exchanger 28, an expansion device 30, an economizer line 32, and an economizer line valve 34. The economizer heat exchanger 28 includes a heat recipient portion 36 and a heat donor portion 38. The system 10 includes a controller 40, a first (main line) valve 42 and a second (bypass line) valve 44.

The heat exchanger 26 can include a condenser that condenses at least a portion of the refrigerant. Alternatively, heat exchanger 26 can be a gas cooler, where no condensation of refrigerant vapor takes place and the gas refrigerant is simply cooled to a lower temperature. The use of a gas cooler would be typical for systems that use $CO_2$ as the system refrigerant.

The first valve 42 is positioned in the suction line 14 which provides a fluid flow path between the evaporator 16 and the multi-stage compressor assembly 18. The multi-stage compressor assembly 18 has the first stage 19 connected to the second stage 21 by the integral inter-stage line 20. Alternatively, the first stage 19 and second stage 21 can be separate compressor units each of which has a single compressive stage. The first stage 19 and second stage 21 interconnected in series by inter-stage line 20. Inter-stage line 20 can include piping or in certain design configurations the inter-stage line 20 can refer to a common plenum or integral compressor cavity connected between the first stage 19 and the second stage 21. The bypass line 22 connects to the suction line 14 upstream of the first valve 42 and bypasses the first stage 19 to connect to the inter-stage line 20 of the multi-stage compressor assembly 18. The second valve 44 is positioned in the bypass line 22 which provides a second fluid flow path extending between the evaporator 16 and the second stage 21 of the compressor assembly 18. The main flow line 24 (of which the suction line 14 is a part) extends serially through the heat exchanger 26, economizer heat exchanger 28, expansion device 30, evaporator 16, and multi-stage compressor assembly 18. The economizer line 32 connects to the main flow line 24 between the heat exchanger 26 and the economizer heat exchanger 28. The economizer line 32 extends through the economizer heat exchanger 28 to connect to the inter-stage line 20 of the multi-stage compressor assembly 18. Alternatively, the economizer line 32 can connect directly to the bypass line 22 prior to the connection of the bypass line 22 with the inter-stage line 20. In the embodiment shown, the economizer line valve 34 is disposed in the economizer line 32 downstream of the economizer heat exchanger 28.

The controller 40 controls the first valve 42, second valve 44, the economizer line valve 34, and the multi-stage compressor assembly 18. More specifically, the controller 40 controls the first valve 42, the second valve 44, and the economizer line valve 34, which are all configured to open and close in response to control signals therefrom to regulate the flow of refrigerant through the system 10.

In one embodiment, the valves 34, 42, and 44 are low cost solenoid valves that are selectively energized to open or close in response to the control signals of the controller 40. Whether valves 34, 42, and 44 are open or closed is dictated by the capacity mode desired for the system 10. In this manner, multiple system 10 capacity modes (each resulting in a different capacity) can be achieved efficiently at low cost.

In another embodiment (not shown), first valve 42 and second valve 44 are combined in a valve assembly that is a three way valve allowing the valve assembly to be positioned in the suction line 14 and communicate with the bypass line 22. The valve assembly can be opened and closed to regulate the flow of refrigerant along both the suction line and the bypass line. Similarly, economizer line valve 34 can be a three way valve assembly, where it combines the function of valve 34 and 44.

The suction line 14 transports refrigerant from the evaporator 16 to the first stage 19. In the first stage, the refrigerant transported through the suction line 14 is compressed to a higher pressure before being discharged into the inter-stage line 20. In the second stage 21, the refrigerant is further compressed to a pressure higher than that of the refrigerant exiting the first stage 19. In FIG. 1, the multi-stage compressor assembly 18 is a single unit with dedicated cylinders comprising the first stage 19 and the second stage 21. In this instance, the inter-stage line 20 would be located integrally within the compressor assembly 18 or under alternative design configurations the flow would pass from first compression stage the second compression stage via a common plenum.

The bypass line 22 connects to suction line 14 and is capable of transporting refrigerant bypassed from the suction line 14 and the first stage 19 to the inter-stage line 20 of the multi-stage compressor assembly 18. Thus, refrigerant transported in the bypass line 22 is undergoes only minimal compression by the first stage 19 just to overcome throttling losses within the multi-stage compressor assembly 18.

As previously indicated, the main flow line 24 interconnects several components of the system 10 in a refrigeration or air conditioning cycle. More particularly, the main flow line 24 transports compressed refrigerant from the multi-stage compressor assembly 18 through the heat exchanger 26 where the refrigerant (previously a vapor) condenses to a liquid. The main flow line 24 directs the fluid through the economizer heat exchanger 28 (which can be operational or idle depending on the capacity mode of the system 10) and through the expansion device 30, where the refrigerant is throttled to a lower pressure liquid-vapor mixture. From the expansion device 30, the main flow line 24 directs the refrigerant to the evaporator 16 where the liquid portion of the refrigerant evaporates to cool a required space. The refrigerant, in vapor state, is transported from the evaporator 16 to the multi-stage compressor assembly 18 via the suction line 14.

In a first capacity mode of operation for the system 10, the controller 40 signals the first valve 42 to open (or remain open) and the second valve 44 to close (or remain closed). This arrangement allows refrigerant to flow only through the suction line 14 to the first stage 19 of the multi-stage compressor assembly 18. The controller 40 also signals the economizer line valve 34 to open. The opening of the economizer line valve 34 allows a portion of the refrigerant from the main flow line 24 to flow through the economizer line 32. While traveling along the economizer line 32, the refrigerant passes through the heat recipient portion 36 of the economizer heat exchanger 28. After passing through the heat recipient portion 36 the refrigerant (in vapor state) has a pressure greater than that of the refrigerant exiting the evaporator 16. The refrigerant flows through the economizer line 32 and is vapor injected into the inter-stage line 20 of the multi-stage compressor assembly 18. In the first capacity mode, the portion of refrigerant continuing on the main flow line 24 and passing through the heat donor portion 38 receives additional cooling from the refrigerant flow passing through the heat recipient portion 36. The refrigerant is throttled in the expansion device 30 and then continues along the main flow line 24 to the evaporator 16. In the first capacity mode, the cooling capacity of the system 10 is at its highest level with a capacity of about 150% of that of the second capacity mode (discussed subsequently).

In the second capacity mode of operation for the system 10, the controller 40 signals the first valve 42 to open (or remain open) and the second valve 44 to close (or remain closed). This arrangement allows refrigerant to flow only through the suction line 14 to the first stage 19 of the multi-stage compressor assembly 18. The controller 40 also signals the economizer line valve 34 to close. Thus, the refrigerant only flows along the main flow line 24 and is not economized (does not receive heat from the heat donor portion 36). In the second capacity mode, the system 10 can be thought of as operating in a basic or standard refrigeration cycle, and thus, is considered at full 100% capacity.

In a third capacity mode, the controller 40 signals the first valve 42 to open (or remain open) and the second valve 44 to open (or remain open). This arrangement allows a portion of the refrigerant from the evaporator 16 to flow through the suction line 14 to the first stage 19 and to the second stage 21 while also allowing a second portion of the refrigerant to flow through the bypass line 22 from the inter-stage line 20 of the multi-stage compressor assembly 18 to the suction line 14. The controller 40 also signals the economizer line valve 34 to close (or remain closed). Thus, the refrigerant only flows along the main flow line 24 and is not economized (does not receive heat from the heat donor portion 36). The third capacity mode allows the system 10 to achieve a capacity of about 45% of that of the second capacity mode.

In a fourth capacity mode of operation for the system 10, the controller 40 signals the first valve 42 to close (or remain closed) and the second valve 44 to open (or remain open). This arrangement allows refrigerant to only flow through the bypass line 22 to the inter-stage line 20 of the multi-stage compressor assembly 18. Therefore, the first stage 19 is bypassed entirely. The controller 40 also signals the economizer line valve 34 to close (or remain closed). Thus, the refrigerant only flows along the main flow line 24 and is not economized (does not receive heat from the heat donor portion 36). The fourth capacity mode allows the system 10 to achieve a capacity of about 35% of that of the second capacity mode.

In a fifth capacity mode, the controller 40 signals the first valve 42 to close (or remain closed) and the second valve 44 to open (or remain open). This arrangement allows refrigerant to only flow through the bypass line 22 to the inter-stage line 20 of the multi-stage compressor assembly 18. Therefore, the first stage 19 is bypassed entirely. The controller 40 also signals the economizer line valve 34 to open (or remain open). The opening of the economizer line valve 34 allows a portion of the refrigerant from the main flow line 24 to flow through the economizer line 32 (and through the heat recipient portion 36 of the economizer heat exchanger 28) and be vapor injected into the inter-stage line 20 of the multi-stage compressor assembly 18.

In a sixth capacity mode of operation for the system 10, the controller 40 signals the first valve 42 to open (or remain open) and the second valve 44 to open (or remain open). This arrangement allows a portion of the refrigerant from the evaporator 16 to flow through the suction line 14 to the first stage 19 and to the second stage 21. The controller 40 also signals the economizer line valve 34 to open (or remain open). The opening of the economizer line valve 34 allows some amount of the refrigerant from the main flow line 24 to flow through the economizer line 32 (and through the heat recipient portion 36 of the economizer heat exchanger 28) and either be vapor injected into the inter-stage line 20 or flow through the bypass line 22 to the suction line 14.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A refrigerant system capable of operating at multiple capacity modes, the system comprising:

an evaporator;

a multi-stage compressor assembly having a first stage and a second stage;

a first fluid flow path extending between the evaporator and the first stage;

a second fluid flow path connected to the first fluid flow path and connected to the multi-stage compressor assembly between the first stage and the second stage;

a first valve disposed along the first fluid flow path at or between the connection between the first fluid flow path and the second fluid flow path and the first stage, the first valve being arranged upstream from the multi-stage compressor assembly and responsive to control signals to selectively regulate flow of refrigerant to the first stage; and a second valve disposed along the second fluid flow path and responsive to control signals to selectively regulate flow of refrigerant along a bypass line;

a heat exchanger, an economizer heat exchanger, and an expansion device;

a main flow line extending from the multi-stage compressor assembly serially through the heat exchanger, economizer heat exchanger, and expansion device, and the evaporator;

an economizer line connected to the main flow line and extending through the economizer heat exchanger to connect either directly to the bypass line or to the multi-stage compressor assembly between the first stage and the second stage;

an economizer line valve disposed on the economizer line and movable between an open and closed position in response to control signals to selectively regulate flow of refrigerant along the economizer line;

wherein the multiple capacity modes includes a first capacity mode and a second capacity mode, a capacity of the system in the first capacity mode being 150% the capacity of the system in the second capacity mode.

2. The system of claim 1, wherein the first valve is responsive to control signals to selectively regulate flow of refrigerant to the first stage of the multi-stage compressor assembly and the second valve is responsive to control signals to selectively regulate flow of refrigerant along the second fluid flow path to and from an inter-stage of the multi-stage compressor assembly.

3. The system of claim 2, wherein in the first capacity mode the first valve is open to allow refrigerant to the first stage, the second valve is closed, and the economizer line valve is open to allow for vapor injection of refrigerant between the first stage and second stage of the compressor assembly.

4. The system of claim 2, wherein in the second capacity mode the first valve is open to allow refrigerant to the first stage of the compressor assembly and the second and economizer line valves are closed.

5. The system of claim 2, wherein in a third capacity mode the first valve is open to allow refrigerant to the first stage, the second valve is open to allow a portion of the refrigerant to flow along the second fluid flow path, and the economizer line valve is closed.

6. The system of claim 2, wherein in a fourth capacity mode the first valve is closed and the second valve is open to allow the refrigerant to bypass the first stage, and the economizer line valve is closed.

7. The system of claim 2, wherein in a fifth capacity mode the first valve is closed and the second valve and economizer line valve are open.

8. The system of claim 2, wherein in a sixth capacity mode the first valve, second valve and economizer line valve are all open.

9. The system of claim 2, wherein the second fluid flow path is connected to the economizer line.

10. The system of claim 1, wherein the economizer line is connected to the main flow line between the heat exchanger and the economizer heat exchanger.

11. The system of claim 1, wherein the economizer line valve is disposed on the economizer line between the heat exchanger and economizer heat exchanger.

12. The system of claim 2, wherein the first valve, the second valve, and the economizer line valve are solenoid valves and a controller electrically connects to and selectively energizes the first valve, the second valve, and the economizer line valve to regulate the opening and closing of the valves.

13. The system of claim 1, wherein the multi-stage compressor assembly comprises a first compressor having a single compressive stage arranged in series with a second compressor having a single compressive stage.

14. The system of claim 13, wherein the first valve, the second valve, and the economizer line valve receive control signals and in response thereto are opened and/or closed in various combinations to provide the refrigerant system multiple capacity modes.

15. A method of operating a refrigerant system at multiple capacity modes, the method comprising:

compressing a refrigerant in at least one of a first stage or a second stage in a multi-stage compressor assembly;

vaporizing the refrigerant in an evaporator;

providing a first fluid flow path extending from the evaporator to the first stage and a second fluid flow path connected to the first fluid flow path and extending to between the first stage and the second stage;

disposing a first valve along the first fluid flow path at or between the connection between the first fluid flow path and second fluid flow path and the first stage, the first valve being arranged upstream from the multi-stage compressor assembly;

operating the first valve to selectively allow for compression of the refrigerant in the first stage of the multi-stage compressor assembly;

disposing a second valve along the second fluid flow path; and operating the second valve to selectively allow the refrigerant to allow refrigerant to fluidly communicate with the multi-stage compressor assembly between the first stage and the second stage;

operating an economizer line valve to selectively allow a portion of the refrigerant to pass from a main flow line between a heat exchanger and an economizer heat exchanger, through the economizer heat exchanger and be vapor injected into the multi-stage compressor assembly between the first stage and the second stage;

wherein the first valve, second valve, and economizer valve are selectively controlled to open and/or close in various combinations to provide the multiple capacity modes, the multiple capacity modes including a first capacity mode and a second capacity mode such that a capacity of the refrigerant system in the first capacity mode is 150% the capacity of the refrigerant system in the second capacity mode.

16. The method of claim 15, further comprising:

operating the economizer line valve to selectively allow a portion of the refrigerant to pass through the economizer heat exchanger and be vapor injected into the multi-stage compressor assembly between the first stage and the second stage.

17. The method of claim 15, wherein the first valve, the second valve, and the economizer line valve comprise solenoid valves that can be opened and/or closed in various combinations to provide the refrigerant system with at least one of six distinctive capacity modes.

18. The method of claim 16, wherein the multi-stage compressor assembly comprises a first compressor having a single compressive stage arranged in series with a second compressor having a single compressive stage.

* * * * *